US009512834B2

(12) United States Patent
Streeter

(10) Patent No.: US 9,512,834 B2
(45) Date of Patent: Dec. 6, 2016

(54) INTEGRAL RESONATORS FOR ROOTS-TYPE SUPERCHARGER

(71) Applicant: EATON CORPORATION, Cleveland, OH (US)

(72) Inventor: Scot Marc Streeter, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 14/669,712

(22) Filed: Mar. 26, 2015

(65) Prior Publication Data

US 2015/0198150 A1 Jul. 16, 2015

Related U.S. Application Data

(63) Continuation of application No. PCT/US2013/057780, filed on Sep. 3, 2013.

(60) Provisional application No. 61/706,248, filed on Sep. 27, 2012.

(51) Int. Cl.

| | |
|---|---|
| ***F02M 35/12*** | (2006.01) |
| ***F04B 39/00*** | (2006.01) |
| ***F04C 29/06*** | (2006.01) |
| ***F02B 33/38*** | (2006.01) |

(52) U.S. Cl.

CPC ..... *F04B 39/0083* (2013.01); *F02B 33/38* (2013.01); *F02M 35/1216* (2013.01); *F02M 35/1266* (2013.01); *F04C 29/061* (2013.01); *F04C 29/068* (2013.01)

(58) Field of Classification Search

CPC ..... F02M 35/12
USPC ..... 181/229; 13/184.54, 184.55, 184.56, 13/184.57
See application file for complete search history.

(56) References Cited

U.S. PATENT DOCUMENTS

| | | | | |
|---|---|---|---|---|
| 4,174,196 | A * | 11/1979 | Mori | F04C 18/16 418/181 |
| 7,604,467 | B2 * | 10/2009 | Prior | F02B 33/38 123/559.1 |
| 7,707,986 | B1 * | 5/2010 | Plaxton | F02M 35/10157 123/184.53 |
| 7,708,113 | B1 * | 5/2010 | Prior | F01N 1/16 123/184.57 |
| 7,934,581 | B2 * | 5/2011 | Kim | F04D 29/665 123/184.53 |
| 8,177,024 | B2 * | 5/2012 | Caliskan | F02M 35/10321 123/184.53 |

(Continued)

FOREIGN PATENT DOCUMENTS

EP 1 657 445 A2 5/2006

OTHER PUBLICATIONS

International Search Report for corresponding International Patent Application No. PCT/US2013/057780 mailed Nov. 4, 2013.

*Primary Examiner* — Forrest M Phillips
(74) *Attorney, Agent, or Firm* — Merchant & Gould P.C.

(57) ABSTRACT

A compressor assembly for an intake system includes: a monolithic housing; a first resonator section formed in the monolithic housing, the first resonator section defining two or more volumes configured to attenuate noise associated with fluid flowing through the monolithic housing; a compressor section formed in the monolithic housing, the compressor section including a compressor configured to compress the fluid flowing through the monolithic housing; and a second resonator section formed in the monolithic housing, the second resonator section defining two or more volumes configured to attenuate noise associated with the fluid flowing through the monolithic housing.

18 Claims, 5 Drawing Sheets

(56) References Cited

U.S. PATENT DOCUMENTS

2005/0150718 A1 7/2005 Knight et al.
2008/0168961 A1* 7/2008 Prior ..... F02M 35/104 123/184.57
2009/0148330 A1 6/2009 Swartzlander
2010/0086402 A1 4/2010 Ouwenga et al.
2010/0193282 A1* 8/2010 Kim ..... F04D 29/665 181/229
2010/0269797 A1* 10/2010 Prior ..... F02B 33/38 123/559.1

* cited by examiner

INTEGRAL RESONATORS FOR ROOTS-TYPE SUPERCHARGER

This application is a Continuation application of PCT/US2013/057780 filed on 3 Sep. 2013, which claims benefit of U.S. Patent Application Ser. No. 61/706,248 filed on 27 Sep. 2012, and which application(s) are incorporated herein by reference. To the extent appropriate, a claim of priority is made to each of the above disclosed applications.

BACKGROUND

Supercharger compressors, such as roots-type blowers, can emit a distinctive noise, often referred to as a whine, during operation, especially at high differential pressure across the device. These high differential pressure conditions typically occur when the compressor is operating on an internal combustion engine at a compression ratio that is on the higher end of a compression ratio range.

The air running through the roots-type blowers can be amplified by the typical housing and bearing plate materials used to manufacture the blowers, as well as the induction systems employed for the end applications. The noise may attain an undesirable level if uncorrected. A resonator, such as that described in U.S. Pat. No. 7,934,581 to Kim, can be used to attenuate the noise associated with the air entering and/or leaving the roots-type blowers.

SUMMARY

In one aspect, a compressor assembly for an intake system includes: a monolithic housing; a first resonator section formed in the monolithic housing, the first resonator section defining two or more volumes configured to attenuate noise associated with fluid flowing through the monolithic housing; a compressor section formed in the monolithic housing, the compressor section including a compressor configured to compress the fluid flowing through the monolithic housing; and a second resonator section formed in the monolithic housing, the second resonator section defining two or more volumes configured to attenuate noise associated with the fluid flowing through the monolithic housing.

In another aspect, an intake system includes: a monolithic housing extending from a first end to a second end; a first resonator section formed in the monolithic housing at the first end, the first resonator section defining a plurality of volumes configured to attenuate noise associated with fluid flowing through the monolithic housing; a compressor section formed in the monolithic housing and in fluid communication with the first resonator section, the compressor section including a roots-type blower configured to compress the fluid flowing through the monolithic housing; and a second resonator section formed in the monolithic housing at the second end, the second resonator section defining two or more volumes configured to attenuate noise associated with the fluid flowing through the monolithic housing.

In yet another aspect, an intake system includes: a cast monolithic housing extending from a first end to a second end; a first resonator section formed in the monolithic housing at the first end, the first resonator section defining a plurality of volumes configured to attenuate noise associated with fluid flowing through the monolithic housing; a compressor section formed in the monolithic housing and in fluid communication with the first resonator section, the compressor section including a roots-type blower configured to compress the fluid flowing through the monolithic housing; and a second resonator section formed in the monolithic housing at the second end, the second resonator section defining two or more volumes configured to attenuate noise associated with the fluid flowing through the monolithic housing; wherein each of the first resonator section and the second resonator section includes: a conduit portion defining an inlet, an outlet, and a plurality of apertures; and a plurality of chambers in communication with the conduit portion through the plurality of apertures.

DETAILED DESCRIPTION

The present disclosure is directed towards compressors such as roots-type blowers. In examples described herein, one or more resonators are integrated into the roots-type blowers to attenuate noise. It will be appreciated that side designations are used herein for convenience only and are not intended to limit how the device may be used. In this regard, it will be appreciated that embodiments in accordance with the principles of the present disclosure can be used in any orientation.

Figure 1:
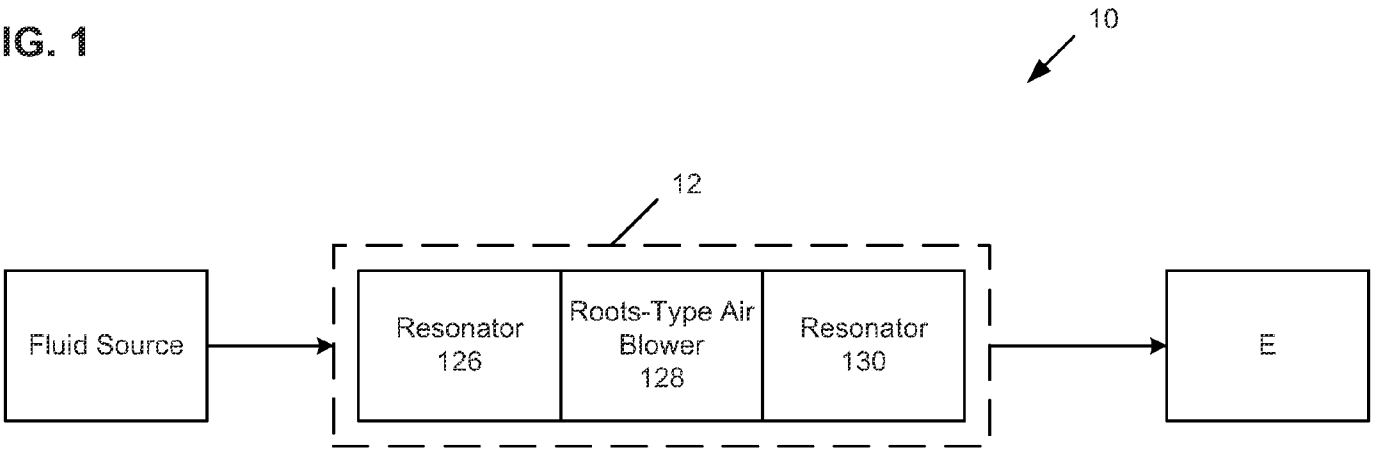
FIG. 1 is a schematic view of an engine and intake system.
Figure 2:
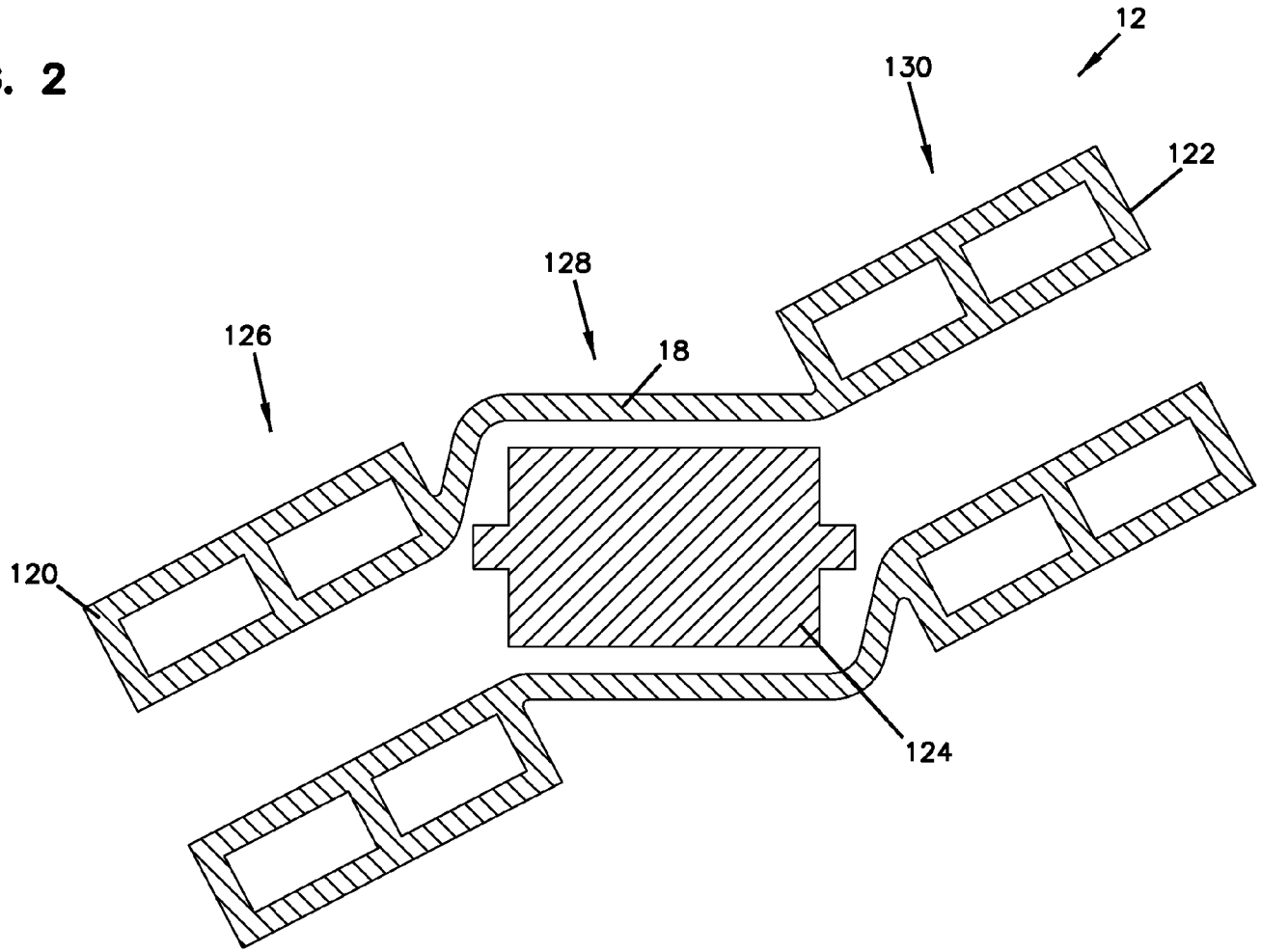
FIG. 2 is a schematic cross-section view of the compressor assembly of FIG. 1.

FIG. 1 is a schematic representation of an engine and intake system 10, including an engine E, a compressor assembly 12, and a source of fluid, such as an air intake or exhaust gas recirculation ("EGR") system. In the embodiment illustrated, the engine E is an internal combustion engine, and the compressor assembly 12 is a portion of a supercharger.

The compressor assembly 12 is an integrated unit including both a compressor section 128 and one or more resonator sections 126, 130. In other words, the compressor assembly 12 includes a single housing (i.e., an integral and/or unitary and/or monolithic structure) including both a compressor and one or more resonators.

Referring now to FIGS. 2-5, the compressor assembly 12 is described in more detail.

The compressor assembly 12 includes a housing 18 extending from a first end 120 to a second end 122. The first end 120 forms a fluid inlet, and the second end 122 forms a fluid outlet. As noted, the housing 18 is formed as a single piece, as described further below.

The housing 18 forms three sections, the first resonator section 126, the compressor section 128, and the second resonator section 130. In this example, the first and second resonator sections 126, 130 are configured to attenuate noise associated with fluid flowing through the compressor assembly 12. The compressor section 128 includes a roots-type blower 124 configured to compressor fluid that is delivered to the engine E.

Figure 3:
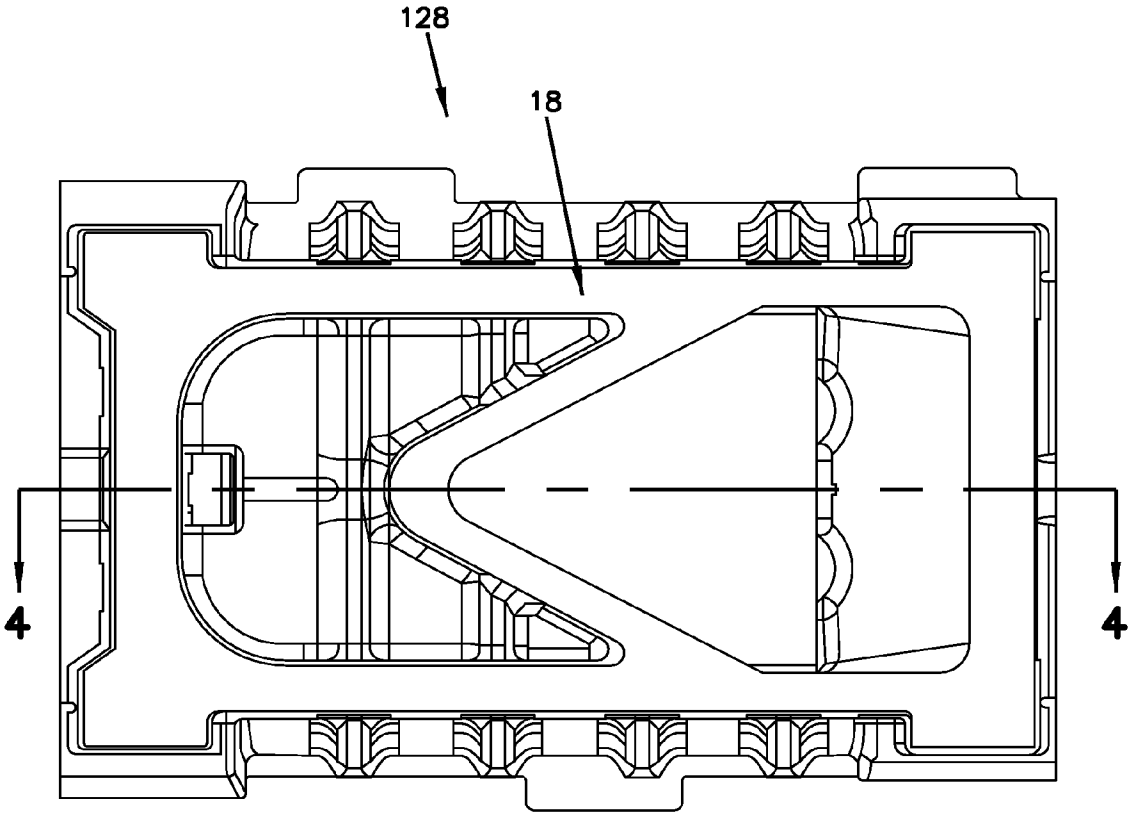
FIG. 3 is a side view of the compressor of the compressor assembly of FIG. 2.
Figure 4:
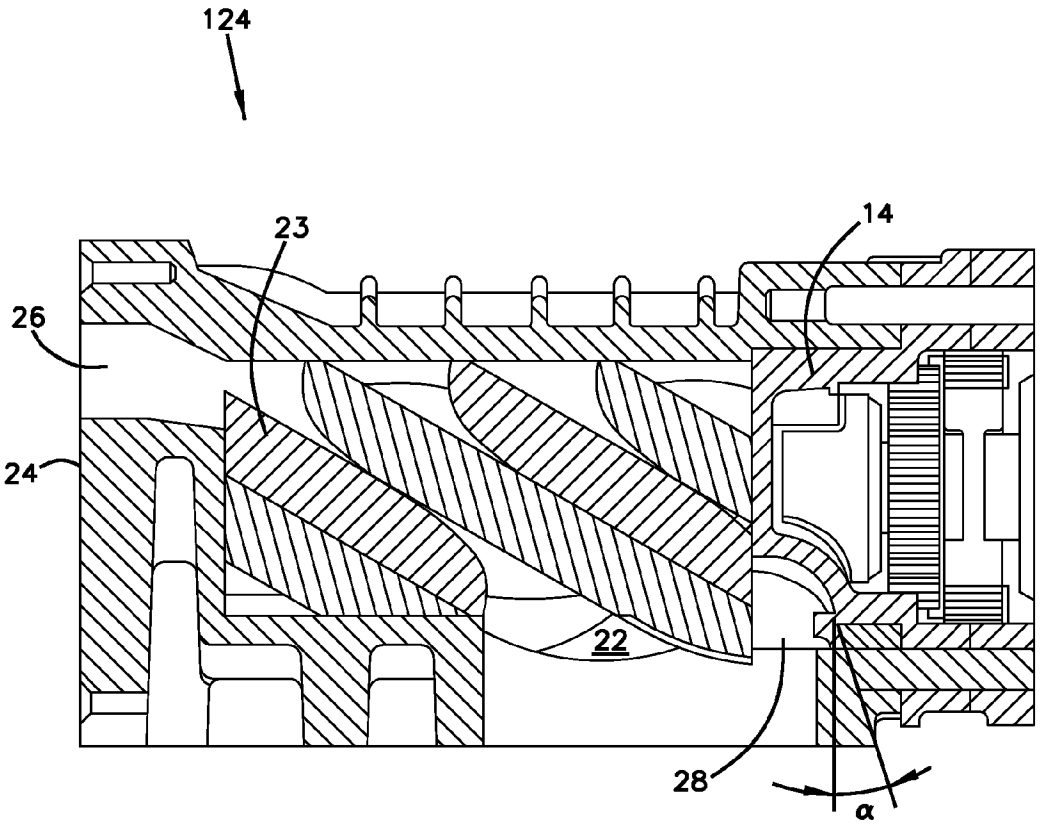
FIG. 4 is a cross-sectional view of an outlet of the compressor of FIG. 3.

Referring now to FIGS. 3 and 4, the compressor section 128 including the roots-type blower 124 is shown in isolation within the housing 18.

The roots-type blower 124 may comprise any air pump with parallel lobed rotors. A plurality of rotors 23 may be disposed within the overlapping cylindrical chambers 22. Each of the rotors 23 may have four lobes. Although four lobes are mentioned in detail, each of the rotors 23 may have fewer or more lobes in other embodiments.

Each of the rotors 23 may be mounted on a rotor shaft for rotation therewith. Each end of each rotor shaft may be rotatingly supported within a bearing plate 14 or a single component housing. At least one of the rotors 23 may utilize any of various input drive configurations (an input shaft portion and/or step up gear set, for example and without limitation) by means of which the roots-type blower 124 may receive input drive torque.

The roots-type blower 124 may include a backplate portion 24. Backplate portion 24 may define an inlet port 26. The inlet port 26 may be in fluid communication with at least one of the chambers 22 in which the rotors 23 are disposed.

The roots-type blower 124 may also define an outlet port 28. The outlet port 28 may also be in fluid communication with at least one of the chambers 22 in which the rotors 23 are disposed. The outlet port 28 may be angled (e.g., not substantially perpendicular to the longitudinal axis 13 of roots-type blower 124). For example, as shown in FIG. 4, the port end surface may be angled outwardly by an angle $\alpha$. Angle $\alpha$ may be less than 45 degrees in an embodiment. Although angle $\alpha$ specifically mentioned as being less than 45 degrees, angle $\alpha$ may be larger or smaller in other embodiments. For example, the angle $\alpha$ may be 30 degrees in some embodiments.

Additional details about the roots-type blower 124 are described in U.S. Patent Application Publication No. 2009/0148330 to Swartzlander, entitled "Optimized Helix Angle Rotors for Roots-Style Supercharger," and/or U.S. Patent Application Publication No. 2010/0086402 to Ouwenga et al., entitled "High Efficiency Supercharger Outlet," the entireties of which are hereby incorporated by reference. Other types of compressors can also be used.

Figure 5:
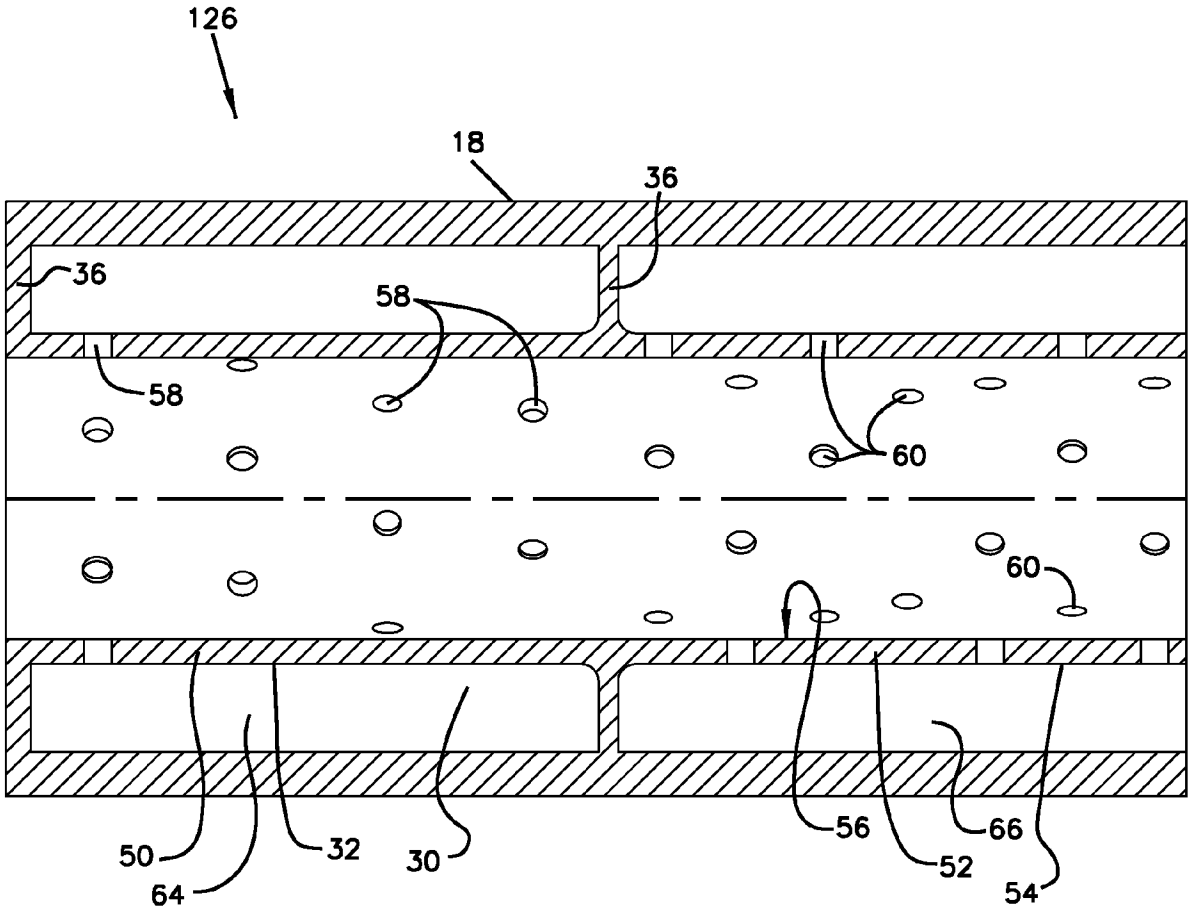
FIG. 5 is a cross-sectional view of one resonator of the compressor assembly of FIG. 2.

Referring now to FIG. 5, the first resonator section 126 is shown in isolation within the housing 18. The first resonator section 126 generally operates to reduce the noise transmitted by fluid flowing through and being compressed by the roots-type blower 124.

The first resonator section 126 includes an inner member 30 having a conduit portion 32, a first annular wall 34, and a second annular wall 36.

In the embodiment illustrated, the conduit portion 32 includes a first conduit portion 50, a second conduit portion 52, an outside conduit surface 54, an inside conduit surface 56, a plurality of first conduit apertures 58, and a plurality of second conduit apertures 60. All of the apertures shown in the sectioned portion of the first conduit portion 50 are first conduit apertures 58, while all of the apertures shown in the sectioned portion of the second conduit portion 52 are second conduit apertures 60.

The annular walls 34, 36, the housing 18, and the conduit portion 32 define first and second chambers 64, 66. In the embodiment illustrated, the first chamber 64 and the second chamber 66 have generally the same volume, although other configurations are possible.

In the embodiment illustrated, each first conduit aperture 58 is generally cylindrical, and each second conduit aperture 60 is generally cylindrical, although the first conduit apertures 58 and the second conduit apertures 60 need not be cylindrical. Each first conduit aperture 58 is generally the same diameter as each second conduit aperture 60.

Additionally, the number of second conduit apertures 60 is greater than the number of the first conduit apertures 58. In one embodiment, the resonator 20 has twenty-four (24) first conduit apertures 58 and thirty-four (34) second conduit apertures 60, where the first conduit apertures 58 are generally the same diameter as the second conduit apertures 60. The first conduit apertures 58 are generally evenly distributed within the first conduit portion 50, and the second conduit apertures 60 are generally evenly distributed within the second conduit portion 52.

Additional details regarding the first resonator section 126 and other similar resonators are described in U.S. Pat. No. 7,934,581 to Kim entitled "Broadband noise resonator," the entirety of which is hereby incorporated by reference. Although the example first resonator section 126 is shown herein, other configurations for a resonator can also be used. The second resonator section 130 is configured in a manner similar to that of the first resonator section 126.

Referring again to FIG. 2, the first and second resonator sections 126, 130 and the compressor section 128 (including the roots-type blower 124) are formed within a single integrated housing 18. In this example, the housing 18 is cast of a metal such as iron or aluminum.

In some examples, the first and second chambers 64, 66 of the resonator sections 126, 130 are formed using various techniques. In one example, the chambers are formed using sand cores or lost foam techniques during casting of the housing 18. In other examples, the annular wall 34 and the conduit portion 32 are formed of a molded polymeric material or a separate cast material that is incorporated into the housing 18 after the housing is cast. For example, the annular wall 34 and the conduit portion 32 can be injection molded or die-cast in place or otherwise formed and fixed within the housing 18.

As depicted, the housing 18 is formed linearly, so that fluid flows axially through the first resonator section 126, into the roots-type blower 124 within the compressor section 128, and finally through the second resonator section 130 before being delivered to the engine E. In other words, the first resonator section 126 is in fluid communication with the compressor section 128, and the compressor section 128 is in fluid communication with the second resonator section 130.

In one example, the roots-type blower 124 includes the high efficiency outlet described in U.S. Patent Application Publication No. 2010/0086402. In such a configuration, fluid leaving the roots-type blower 124 is directed at approximately a 30 degree angle relative to the longitudinal axis of the blower, so that the second resonator section 130 is positioned approximately 30 degrees off of the longitudinal axis of the roots-type blower 124. In this configuration, the housing 18 is formed so that the second resonator section 130 accommodates this angle.

There can be various advantages associated with incorporating the resonators into the same housing as that of the compressor. For example, placing the resonators in the same housing as the compressor allows the resonators to be positioned close to the compressor, thereby minimizing the untreated volume through which the fluid must travel before being attenuated. In addition, the single housing minimizes assembly time and the number of components for the compressor assembly, thereby resulting in lower assembly cost and complexities.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A compressor assembly for an intake system, comprising:

a monolithic housing;

a first resonator section formed in the monolithic housing, the first resonator section defining two or more volumes configured to attenuate noise associated with fluid flowing through the monolithic housing, the first resonator section defining a first inlet for receiving the fluid into the monolithic housing and defining a first outlet;

a compressor section formed in the monolithic housing, the compressor section including a compressor configured to receive the fluid from the first outlet and to compress the fluid flowing through the monolithic housing; and a second resonator section formed in the monolithic housing, the second resonator section defining two or more volumes configured to attenuate noise associated with the fluid flowing through the monolithic housing, the second resonator section defining a second inlet and a second outlet, wherein the fluid compressed by the compressor is received at the second inlet and discharged from the monolithic housing through the second outlet;

wherein each of the first resonator section and the second resonator section includes a conduit portion defining an inlet, an outlet, and a plurality of apertures, and a plurality of chambers in communication with the conduit portion through the plurality of apertures.

2. The compressor assembly of claim 1, wherein the first resonator section is in fluid communication with the compressor section, and the compressor section is in fluid communication with the second resonator section.

3. The compressor assembly of claim 1, wherein the monolithic housing is cast.

4. The compressor assembly of claim 3, wherein the compressor is a roots-type blower.

5. The compressor assembly of claim 1, wherein the compressor is a roots-type blower.

6. The compressor assembly of claim 1, wherein the plurality of chambers is formed after the housing is cast.

7. The compressor assembly of claim 6, wherein the first resonator section, the compressor section, and the second resonator section are aligned axially through the housing.

8. The compressor assembly of claim 1, wherein the first resonator section, the compressor section, and the second resonator section are aligned axially through the housing.

9. The compressor assembly of claim 1, wherein the second resonator section is angled with respect to an axial alignment of the first resonator section and the compressor section.

10. An intake system, comprising:

a monolithic housing extending from a first end to a second end;

a first resonator section formed in the monolithic housing at the first end, the first resonator section defining a plurality of volumes configured to attenuate noise associated with fluid flowing through the monolithic housing, the first resonator section defining a first inlet for receiving the fluid into the monolithic housing and defining a first outlet;

a compressor section formed in the monolithic housing and in fluid communication with the first resonator section, the compressor section including a roots-type blower configured to receive the fluid from the first outlet and to compress the fluid flowing through the monolithic housing; and a second resonator section formed in the monolithic housing at the second end, the second resonator section defining two or more volumes configured to attenuate noise associated with the fluid flowing through the monolithic housing, the second resonator section defining a second inlet and a second outlet, wherein the fluid compressed by the compressor is received at the second inlet and discharged from the monolithic housing through the second outlet;

wherein each of the first resonator section and the second resonator section includes a conduit portion defining an inlet, an outlet, and a plurality of apertures, and a plurality of chambers in communication with the conduit portion through the plurality of apertures.

11. The intake system of claim 10, wherein the monolithic housing is cast.

12. The intake system of claim 10, wherein the plurality of chambers is formed after the housing is cast.

13. The intake system of claim 10, wherein the first resonator section, the compressor section, and the second resonator section are aligned axially through the housing.

14. The intake system of claim 10, wherein the second resonator section is angled with respect to an axial alignment of the first resonator section and the compressor section.

15. An intake system, comprising:

a cast monolithic housing extending from a first end to a second end;

a first resonator section formed in the monolithic housing at the first end, the first resonator section defining a plurality of volumes configured to attenuate noise associated with fluid flowing through the monolithic housing, the first resonator section defining a first inlet for receiving the fluid into the monolithic housing and defining a first outlet;

a compressor section formed in the monolithic housing and in fluid communication with the first resonator section, the compressor section including a roots-type blower configured to receive the fluid from the first outlet and to compress the fluid flowing through the monolithic housing; and a second resonator section formed in the monolithic housing at the second end, the second resonator section defining two or more volumes configured to attenuate noise associated with the fluid flowing through the monolithic housing, the second resonator section defining a second inlet and a second outlet, wherein the fluid compressed by the compressor is received at the second inlet and discharged from the monolithic housing through the second outlet;

wherein each of the first resonator section and the second resonator section includes:

a conduit portion defining an inlet, an outlet, and a plurality of apertures; and a plurality of chambers in communication with the conduit portion through the plurality of apertures.

16. The intake system of claim 15, wherein the plurality of chambers is formed after the housing is cast.

17. The intake system of claim 15, wherein the first resonator section, the compressor section, and the second resonator section are aligned axially through the housing.

18. The intake system of claim 15, wherein the second resonator section is angled with respect to an axial alignment of the first resonator section and the compressor section.

* * * * *